US010371453B2

(12) United States Patent
Lee et al.

(10) Patent No.: US 10,371,453 B2
(45) Date of Patent: Aug. 6, 2019

(54) DOUBLE PIPE HEAT EXCHANGER AND METHOD OF MANUFACTURING THE SAME

(71) Applicant: HS R & A CO., LTD, Gyeongsangnam-do (KR)

(72) Inventors: Jongkang Lee, Busan (KR); Byeongki Kang, Busan (KR); Deokhyun Lim, Gyeongsangnam-do (KR); Youngjun Kim, Gyeongsangnam-do (KR); Jaewon Sim, Gyeongsangnam-do (KR)

(73) Assignee: HS R & A CO., LTD, Gyeongsangnam-do (KR)

( * ) Notice: Subject to any disclaimer, the term of this patent is extended or adjusted under 35 U.S.C. 154(b) by 30 days.

(21) Appl. No.: 15/584,380

(22) Filed: May 2, 2017

(65) Prior Publication Data

US 2018/0045467 A1 Feb. 15, 2018

(30) Foreign Application Priority Data

Aug. 10, 2016 (KR) ..... 10-2016-0101983

(51) Int. Cl.
*F28D 7/10* (2006.01)
*F28F 9/02* (2006.01)
(Continued)

(52) U.S. Cl.
CPC ..... *F28D 7/106* (2013.01); *F28F 1/06* (2013.01); *F28F 1/08* (2013.01); *F28F 1/36* (2013.01);
(Continued)

(58) Field of Classification Search
CPC ..... F28D 7/106; F28F 1/06
(Continued)

(56) References Cited

U.S. PATENT DOCUMENTS 813,918 A * 2/1906 Schmitz ..... F28D 7/103 122/367.2
1,703,037 A * 2/1929 Heck ..... F16L 13/04 219/137 R
(Continued)

FOREIGN PATENT DOCUMENTS

CN 1773154 A 5/2006
CN 201218675 Y 4/2009
(Continued)

OTHER PUBLICATIONS

Extended European Search Report issued in European Patent Application No. 17152027.3, dated Jul. 14, 2017.
(Continued)

*Primary Examiner* — Allen J Flanigan
(74) *Attorney, Agent, or Firm* — Marshall, Gerstein & Borun LLP

(57) ABSTRACT

A double pipe heat exchanger and a method of manufacturing the same are provided. The double pipe heat exchanger including an outer pipe and an inner pipe having a first flow channel therein and having an outer diameter smaller than an inner diameter of the outer pipe and inserted into the outer pipe to form a second flow channel between the inner pipe and the outer pipe includes a plurality of first grooves formed in a spiral shape in a lengthwise direction at an outer circumferential surface of the inner pipe to enable the second flow channel to have at least partially a spiral shape and at least one second groove each formed in a portion between two first grooves adjacent to an outer circumferential surface of the inner pipe and formed along the first groove.

10 Claims, 18 Drawing Sheets

(51) Int. Cl.

| | |
|---|---|
| ***F28F 1/42*** | (2006.01) |
| ***F28F 1/06*** | (2006.01) |
| ***F28F 1/08*** | (2006.01) |
| ***F28F 1/36*** | (2006.01) |

(52) U.S. Cl.
CPC ..... *F28F 1/426* (2013.01); *F28F 9/0234* (2013.01); *F28F 2210/06* (2013.01)

(58) Field of Classification Search
USPC ..... 165/154, 156; 403/375; 285/189, 192
See application file for complete search history.

(56) References Cited

U.S. PATENT DOCUMENTS

| | | | | |
|---|---|---|---|---|
| 5,366,006 | A * | 11/1994 | Lu | F28F 9/162 165/173 |
| 5,992,512 | A * | 11/1999 | Tsuri | B21C 37/207 165/133 |
| 7,188,664 | B2 * | 3/2007 | Fuller | F28D 9/0043 165/140 |
| 7,887,099 | B2 * | 2/2011 | Kurata | B21C 37/154 285/123.3 |
| 9,091,487 | B2 | 7/2015 | Byon et al. | |
| 2006/0096314 | A1 * | 5/2006 | Nakamura | F16L 7/00 62/498 |
| 2012/0043055 | A1 * | 2/2012 | Byon | F28D 7/106 165/96 |

FOREIGN PATENT DOCUMENTS

| | | | |
|---|---|---|---|
| CN | 102080908 | A | 6/2011 |
| CN | 102116585 | A | 7/2011 |
| DE | 10 2006 061 048 | A1 | 7/2007 |
| EP | 2 551 622 | A2 | 1/2013 |
| JP | 2001289583 | A | 10/2001 |
| JP | 39-35789 | | 3/2007 |
| JP | 2007-85595 | A | 4/2007 |
| KR | 20120017315 | A | 2/2012 |
| KR | 200459178 | Y1 | 3/2012 |
| KR | 20130000626 | A | 1/2013 |
| KR | 20140054864 | A | 5/2014 |
| KR | 101415738 | B1 | 7/2014 |
| WO | WO-02/48631 | A2 | 6/2002 |
| WO | WO-2009/060487 | A1 | 5/2009 |

OTHER PUBLICATIONS

Office Action issued in Japanese Patent Application No. 2017-021824, dated Oct. 6, 2017.
Office Action issued in Korean Patent Application No. 10-2016-0101983, dated Oct. 20, 2016.
Office Action issued in Chinese Patent Application No. 201710332107.X, dated Dec. 25, 2018.

* cited by examiner

DOUBLE PIPE HEAT EXCHANGER AND METHOD OF MANUFACTURING THE SAME

CROSS-REFERENCE TO RELATED APPLICATION

This application claims the benefit under 35 U.S.C. § 119(a) of Korean patent application filed on Aug. 10, 2016 in the Korean Intellectual Property Office and assigned Serial number 10-2016-0101983, the entire disclosure of which is hereby incorporated by reference.

BACKGROUND OF THE INVENTION

Field of the Invention

The present invention relates to a double pipe heat exchanger and a method of manufacturing the same, and more particularly, to a double pipe heat exchanger and a method of manufacturing the same that enables a heat exchange between a fluid flowing in an outer pipe and a fluid flowing in an inner pipe by disposing the inner pipe having a spiral structure at the outer pipe.

Description Of The Related Art

A heat exchange between a low temperature and a high temperature is required in various fields, and an apparatus such as a heat exchanger may be used for a heat exchange between a high temperature fluid and a low temperature fluid. For example, in a refrigerator or a vehicle, for a heat exchange, a double pipe structure is used that enables a high temperature fluid and a low temperature fluid to exchange a heat while simultaneously flowing. For example, by adding a fluid line between a condenser and an evaporator to a suction line between an evaporator and a compressor, a double pipe may be formed. Thereby, a low temperature fluid of the suction line may absorb a high temperature heat of the fluid line. Therefore, cooling efficiency of a cooling apparatus may be improved. A structure of a double pipe heat exchanger of various forms is well-known in this field.

A conventional double pipe heat exchanger has an inner pipe 10 and an outer pipe 20, as illustrated in FIG. 1. The inner pipe 10 has a first flow channel 12 therein, and in the first flow channel 12, a first fluid is injected and flows.

The outer pipe 20 is installed at a circumference of an outer surface of the inner pipe 10. Particularly, a second flow channel 30 is formed between the outer pipe 20 and the inner pipe 10, and in the second flow channel 30, a second fluid is injected and flows. In this case, at an outer circumferential surface of the inner pipe 10, a helical groove 14 is formed, and a second fluid flows along the helical groove 14.

Therefore, a second fluid injected into the second flow channel 30 flows at a temperature different from the first fluid flowing along the first flow channel 12; thus, a mutual heat exchange operation occurs.

In a conventional double pipe heat exchanger produced in such a structure, by the helical groove 14 formed at an outer circumferential surface of the inner pipe 10, a portion protruded between the helical grooves 14 contacts an inner circumferential surface of the outer pipe 20; thus, a flow rate is not partially secured and a heat exchange area between the first fluid and the second fluid is thereby reduced so that heat exchange efficiency may deteriorate.

Further, in the process of coupling the inner pipe 10 to the outer pipe 20, it is preferable that both side ends of the helical groove 14 formed at the inner pipe 10, i.e., a portion in which the helical groove 14 starts and terminates, are coupled to correspond to a portion in which an external fluid of the outer pipe 20 is injected and discharged; however, in a state in which the inner pipe 10 is inserted into the outer pipe 20, a movement occurs at the inner pipe 10 inserted into the outer pipe 20 when an additional process is performed. As a result, there is a problem that the inner pipe 10 cannot be coupled at an accurate location.

A further problem is that, when coupling the inner pipe 10 to the outer pipe 20 by a welding process, it is difficult to weld so that sufficient airtightness is maintained in a portion coupling the inner pipe 10 to the outer pipe 20.

SUMMARY OF THE INVENTION

The present invention has been made in view of the above problems and provides a double pipe heat exchanger and a method of manufacturing the same that can improve heat exchange efficiency by increasing a flow rate flowing between an outer pipe and an inner pipe through a second groove by forming the second groove at an outer circumferential surface of the inner pipe.

In accordance with an aspect of the present invention, a double pipe heat exchanger including an outer pipe and an inner pipe having a first flow channel therein and having an outer diameter smaller than an inner diameter of the outer pipe and inserted into the outer pipe to form a second flow channel between the inner pipe and the outer pipe includes a plurality of first grooves formed in a spiral shape in a lengthwise direction at an outer circumferential surface of the inner pipe to enable the second flow channel to have at least partially a spiral shape and at least one second groove each formed in a portion between two first grooves adjacent to an outer circumferential surface of the inner pipe and formed along the first grooves.

The second groove may have a depth smaller than that of the first groove.

The second groove may be formed in a U-shaped groove.

The first grooves may be each formed at 3 locations at an outer circumferential surface of the inner pipe, and the second grooves may be each formed between two first grooves adjacent to an outer circumferential surface of the inner pipe.

The outer pipe may include a temporary fastening portion that is formed by clamping in at least one point in which the inner pipe is coupled to the outer pipe in a state in which the inner pipe is inserted into the outer pipe and that contacts at least one portion of an outer circumferential surface of the inner pipe.

The temporary fastening portion may include a plurality of pressing grooves in which an inner circumferential surface of the outer pipe pressed by pressing an outer circumferential surface of the outer pipe presses an outer circumferential surface of the inner pipe, and the pressing grooves may be formed in a state separated by a predetermined gap along a circumference of an outer circumferential surface of the outer pipe.

The double pipe heat exchanger may further include, at both ends of the outer pipe, a first connection pipe formed in a state in which a portion of the outer pipe is expanded to inject a fluid from the outside, an expanded pipe portion to which the second connection pipe that discharges an injected fluid is connected, and a reduced pipe portion in which an end portion of each expanded pipe portion is formed in a reduced pipe state.

The expanded pipe portion may include a coupling hole that communicates with the second flow channel by coupling the first connection pipe and the second connection pipe and a latch jaw protruded in a central direction of the coupling hole from an inner circumferential surface of the coupling hole, and the first connection pipe and the second connection pipe may include a coupling protrusion extended from the each connection pipe to be coupled to the coupling hole and a bead protruded by a predetermined height at an outer circumferential edge of the coupling protrusion to be latched to the latch jaw when each connection pipe is coupled to the coupling hole to limit an insertion depth of the each connection pipe.

The each reduced pipe portion may have a pressing groove that presses an end portion of the each reduced pipe portion in a state in which the inner pipe is inserted into the outer pipe to maintain airtightness between the outer pipe and the inner pipe.

The pressing groove may press an outer circumferential surface of the reduced pipe portion with a rolling processing method and thereby an inner circumferential surface of the reduced pipe portion may come into close contact with an outer circumferential surface of the inner pipe.

In accordance with another aspect of the present invention, a method of manufacturing a double pipe heat exchanger including an outer pipe and an inner pipe having a first flow channel therein and having an outer diameter smaller than an inner diameter of the outer pipe and inserted into the outer pipe to form a second flow channel between the inner pipe and the outer pipe includes preparing the outer pipe and the inner pipe, forming a plurality of first grooves to form the second flow channel in a spiral shape at an outer circumferential surface of the inner pipe, forming a plurality of second grooves to have a depth smaller than that of the first groove between two first grooves adjacent to an outer circumferential surface of the inner pipe, forming an expanded pipe portion at an end portion of the outer pipe and a reduced pipe portion at an end portion of the each expanded pipe portion, forming a coupling hole at the expanded pipe portion, inserting the inner pipe into the outer pipe, and forming a pressing groove at each reduced pipe portion of the outer pipe into which the inner pipe is inserted and coupling the inner pipe to the pressing groove.

Inserting the inner pipe into the outer pipe may include forming a temporary fastening portion having a plurality of pressing grooves for fixing a location of the inner pipe within the outer pipe by clamping an outer circumferential surface of the outer pipe in a state in which the inner pipe is inserted into the outer pipe.

Forming a pressing groove at each reduced pipe portion of the outer pipe into which the inner pipe is inserted and coupling the inner pipe to the pressing groove may include forming the pressing groove with a rolling processing method that presses an outer circumferential surface of each reduced pipe portion formed at both sides of the outer pipe with a rolling roller.

The method may further include, after forming a pressing groove at each reduced pipe portion of the outer pipe into which the inner pipe is inserted and coupling the inner pipe to the pressing groove, coupling the first connection pipe that injects a fluid from the outside and the second connection pipe that discharges an injected fluid to the each coupling hole.

The method may further include, after forming a plurality of second grooves to have a depth smaller than that of the first groove between two first grooves adjacent to an outer circumferential surface of the inner pipe and forming an expanded pipe portion at an end portion of the outer pipe and a reduced pipe portion at an end portion of the each expanded pipe portion, washing by ultrasonic waves the inner pipe in which the first groove and the second groove are formed and the outer pipe in which the expanded pipe portion, the reduced pipe portion, and the coupling hole are formed.

(Advantages)

According to an exemplary embodiment of the present invention, in a double pipe heat exchanger and a method of manufacturing the same, by increasing a flow rate of a fluid flowing through a second flow channel by forming a second groove at an outer circumferential surface of an inner pipe, a heat exchange area with a first fluid flowing through a first flow channel increases; thus, heat exchange efficiency can be improved to the maximum.

Further, by forming a temporary fastening portion in the outer pipe into which the inner pipe is inserted, in a state in which the inner pipe is coupled to the outer pipe, when an additional work is performed, the inner pipe is prevented from moving; thus, the inner pipe can be coupled at an accurate location.

Further, in each reduced pipe portion of an outer pipe into which an inner pipe is inserted, a pressing groove for mechanical sealing is formed through a rolling process; and by finally coupling the inner pipe inserted into the outer pipe through a welding process, sufficient airtightness can be secured.

BRIEF DESCRIPTION OF THE DRAWINGS

The objects, features, and advantages of the present invention will be more apparent from the following detailed description in conjunction with the accompanying drawings, in which.

DETAILED DESCRIPTION OF EXEMPLARY EMBODIMENTS

Hereinafter, exemplary embodiments of the present invention will be described in detail with reference to the accompanying drawings. The same reference numbers are used throughout the drawings to refer to the same or like parts. Further, detailed descriptions of well-known functions and structures incorporated herein may be omitted to avoid obscuring the subject matter of the present invention.

Hereinafter, an exemplary embodiment of the present invention will be described with reference to FIGS. 2 to 9.

Figure 1:
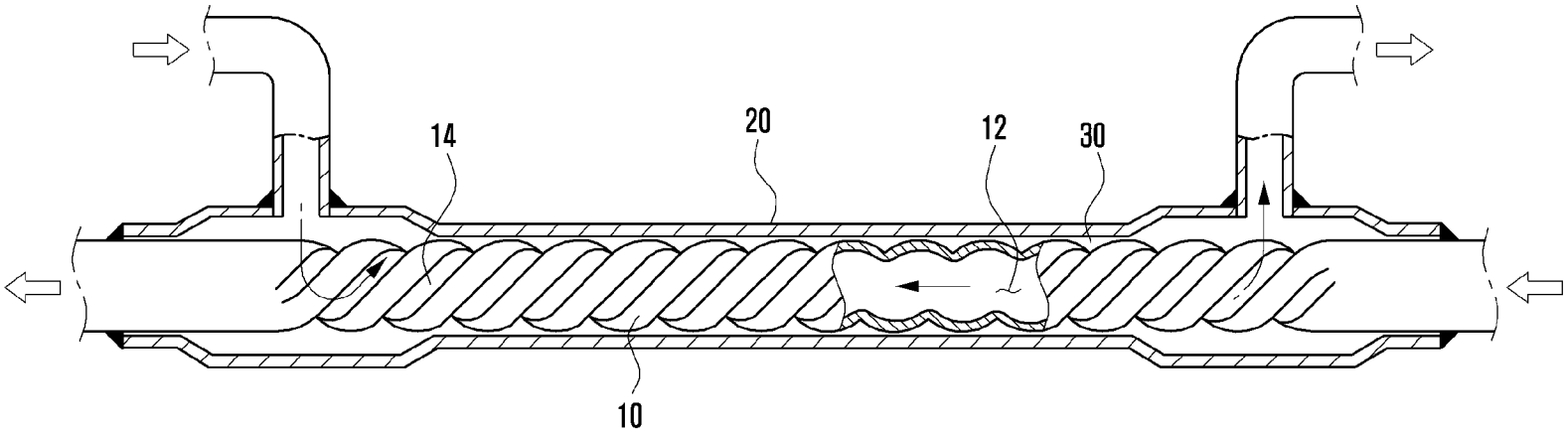
FIG. 1 is a cross-sectional view illustrating a structure of a conventional double pipe heat exchanger.
Figure 2:
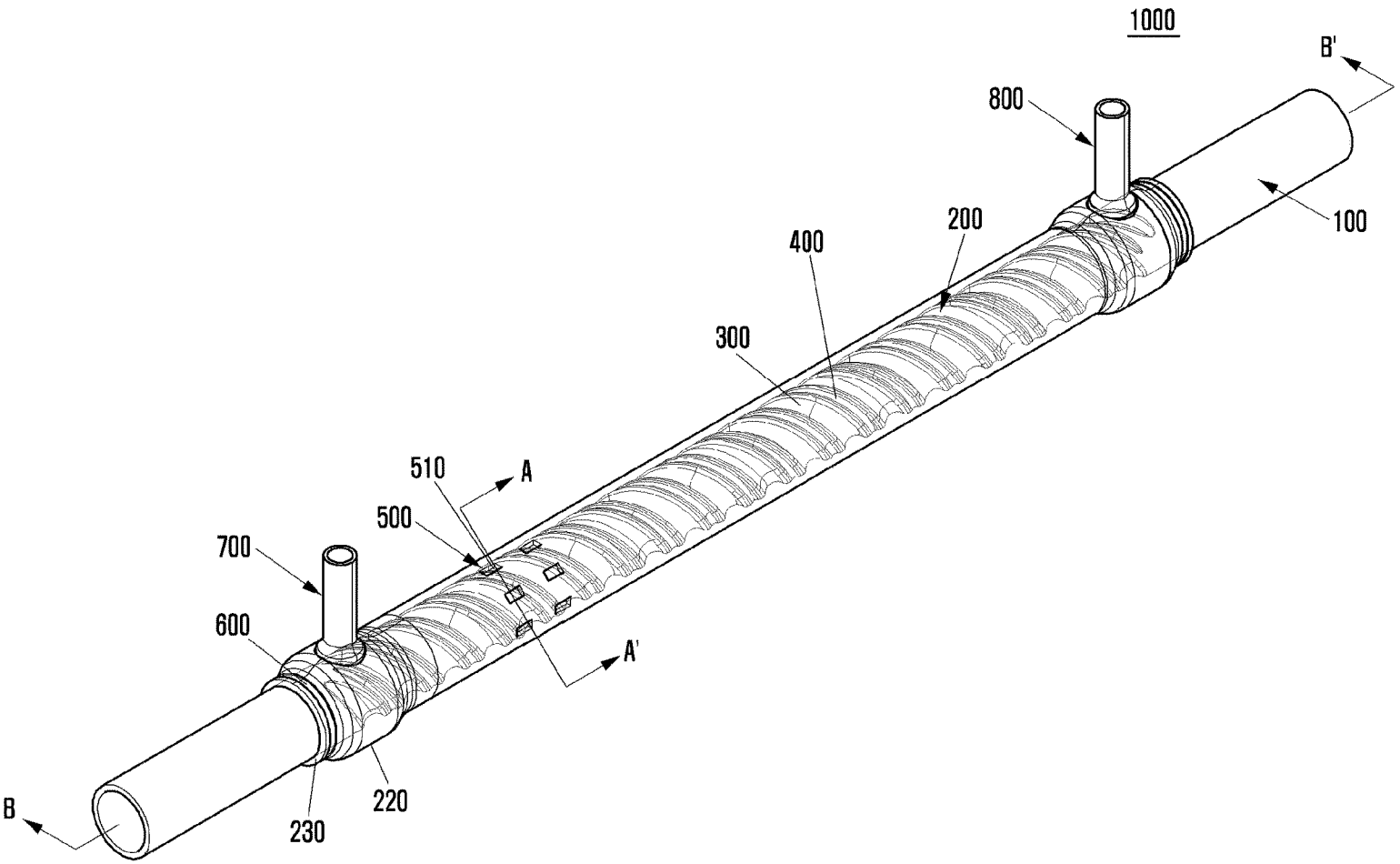
FIG. 2 is a perspective view illustrating a structure of a double pipe heat exchanger according to an exemplary embodiment of the present invention.
Figure 3:
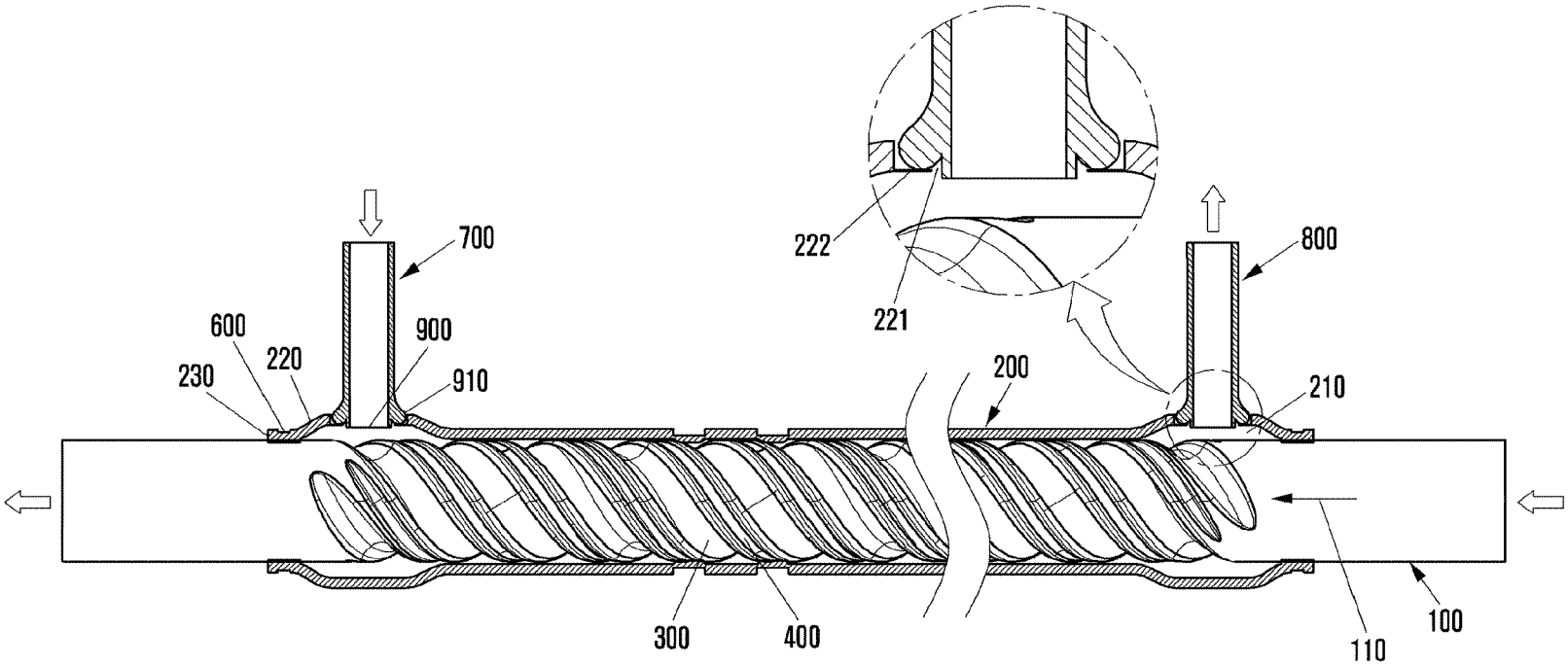
FIG. 3 is a cross-sectional view illustrating a structure of a double pipe heat exchanger according to an exemplary embodiment of the present invention.
Figure 4:
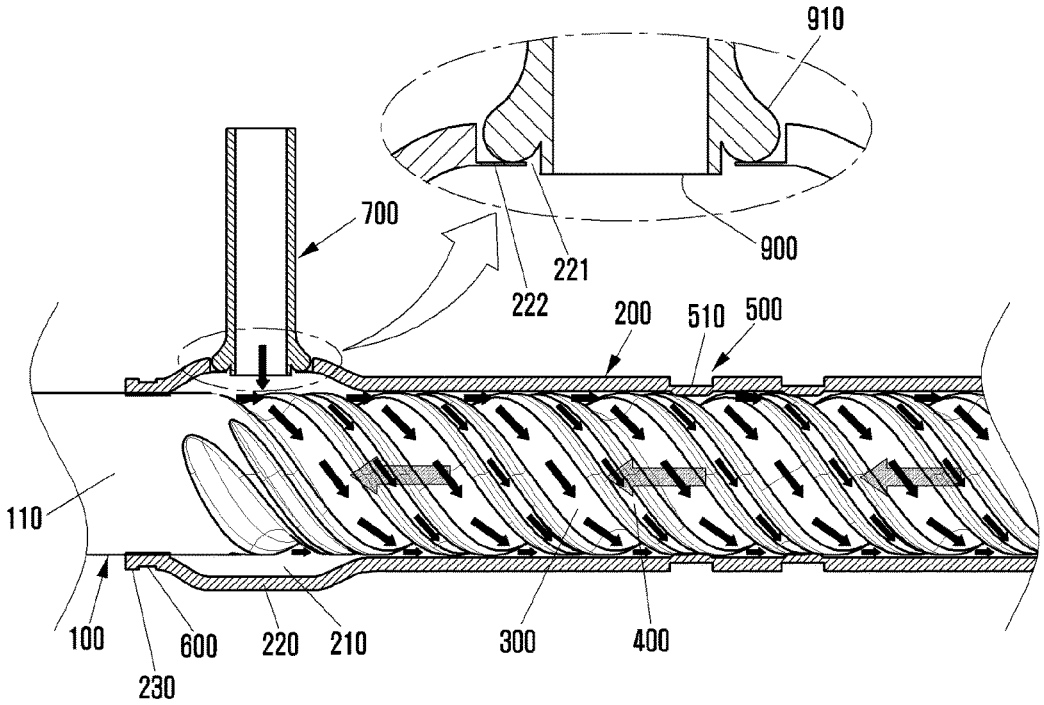
FIG. 4 is a diagram illustrating a state in which a first fluid flows to a first flow channel of a double pipe heat exchanger and in which a second fluid flows to a second flow channel thereof according to an exemplary embodiment of the present invention.

FIG. 2 is a perspective view illustrating a structure of a double pipe heat exchanger according to an exemplary embodiment of the present invention, FIG. 3 is a cross-sectional view illustrating a structure of a double pipe heat exchanger according to an exemplary embodiment of the present invention, and FIG. 4 is a diagram illustrating a state in which a first fluid flows to a first flow channel of a double pipe heat exchanger and in which a second fluid flows to a second flow channel thereof according to an exemplary embodiment of the present invention.

Figure 5A:
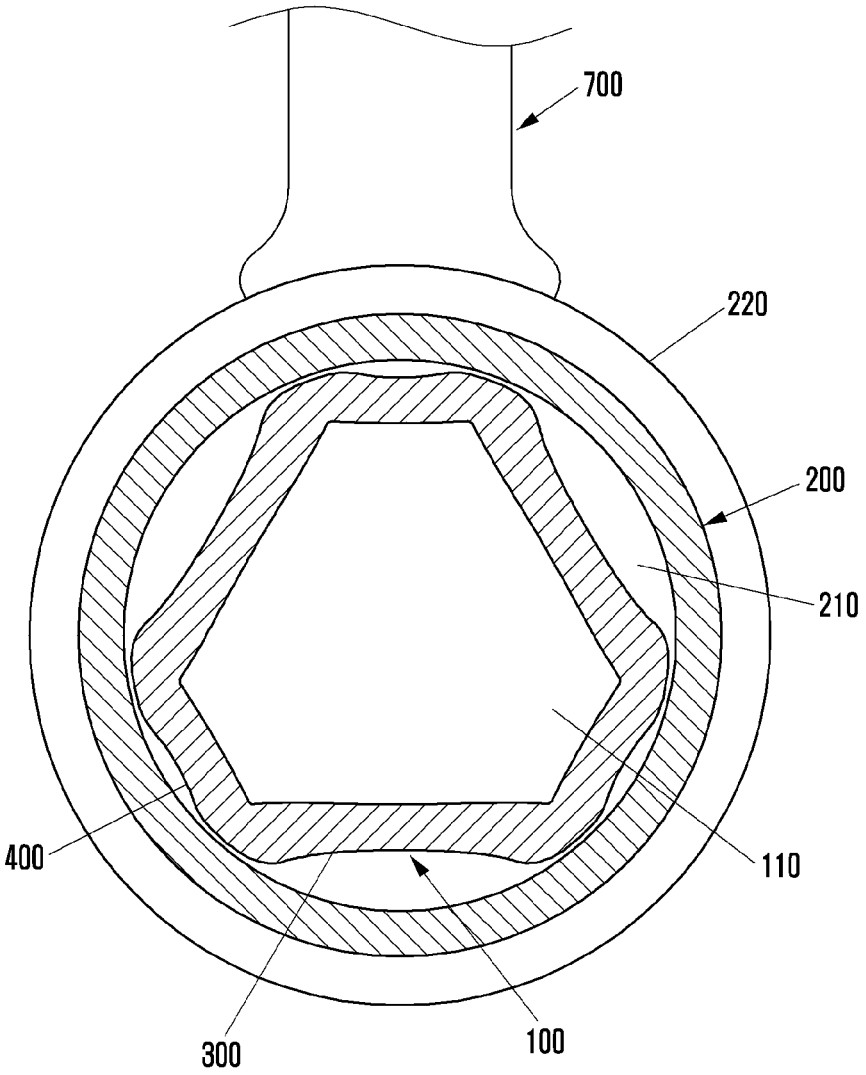
FIGS. 5A-5C are a cross-sectional views illustrating an example of sectional shapes of a spiral structure of a double pipe heat exchanger according to an exemplary embodiment of the present invention.
Figure 5B:
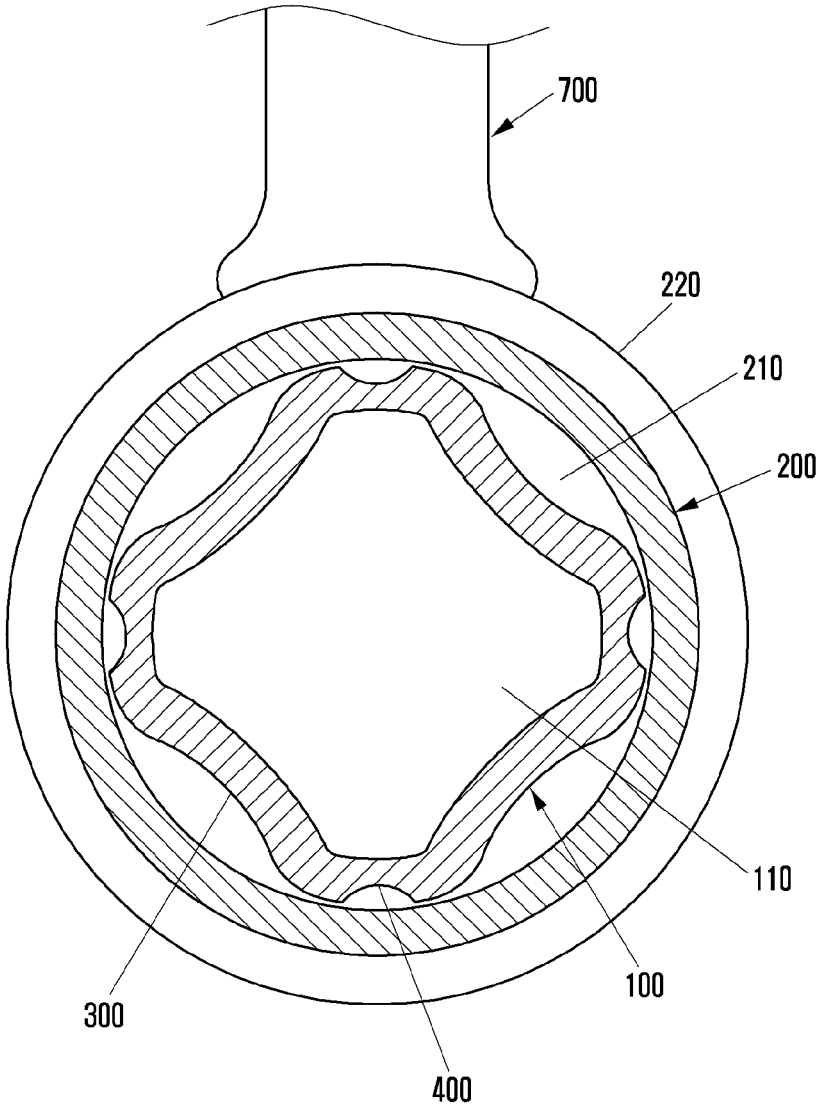
Figure 5C:
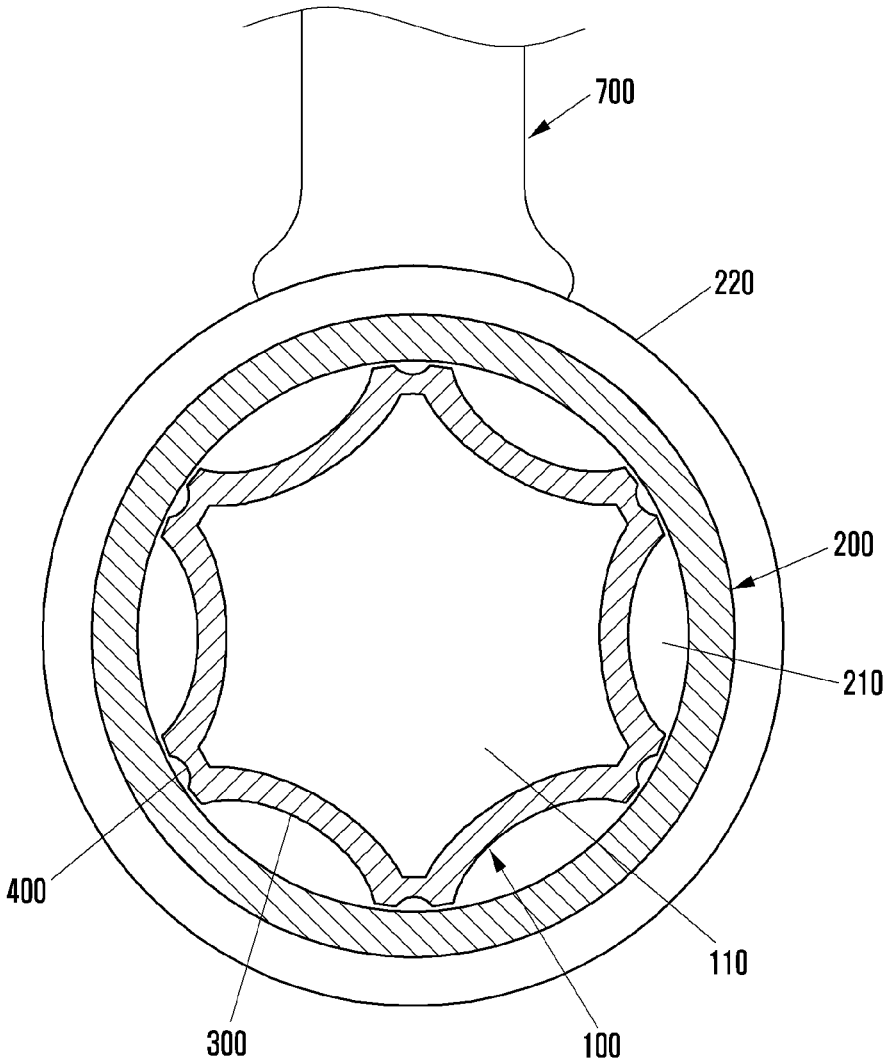
Figure 6:
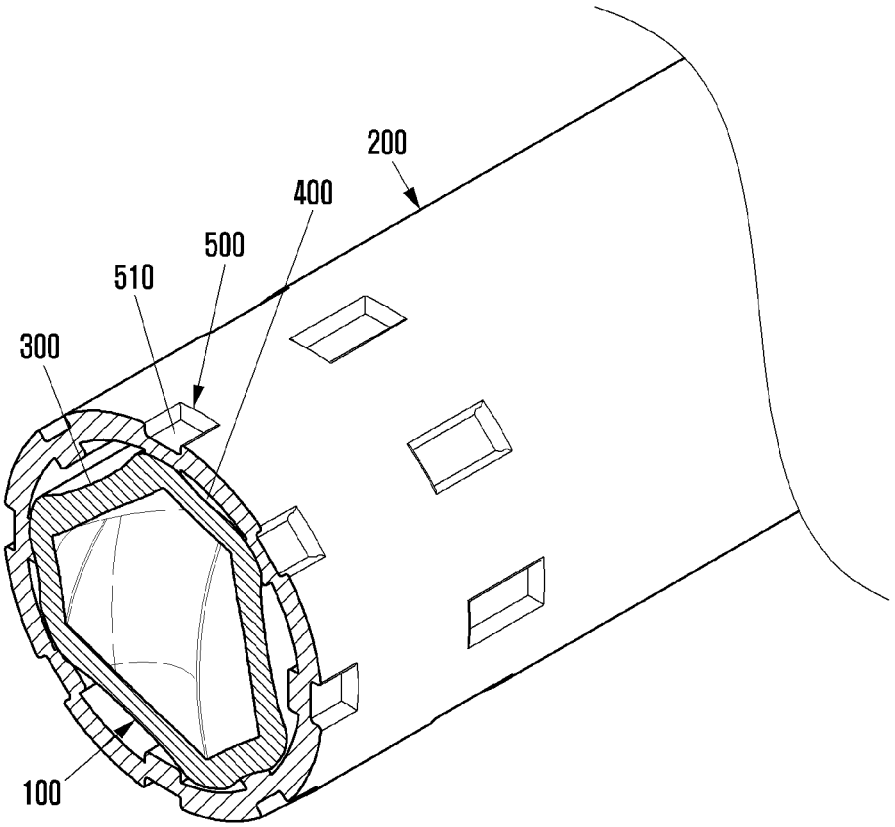
FIG. 6 is a perspective view illustrating a temporary fastening portion structure formed in an outer pipe of a double pipe heat exchanger according to an exemplary embodiment of the present invention.

FIG. 5 is a cross-sectional view illustrating an example of sectional shapes of a spiral structure of a double pipe heat exchanger according to an exemplary embodiment of the present invention, and FIG. 6 is a perspective view illustrating a temporary fastening portion structure formed in an outer pipe of a double pipe heat exchanger according to an exemplary embodiment of the present invention.

Figure 7:
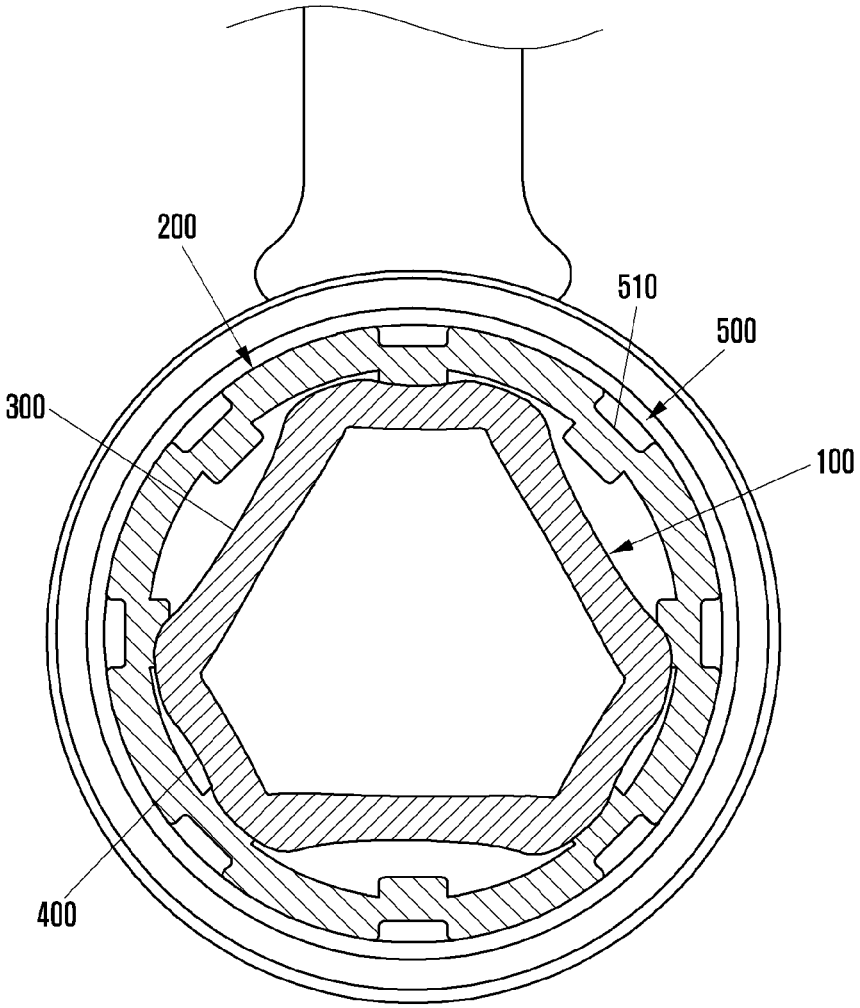
FIG. 7 is a cross-sectional view illustrating a structure of a temporary fastening portion formed in an outer pipe of a double pipe heat exchanger according to an exemplary embodiment of the present invention.
Figure 8:
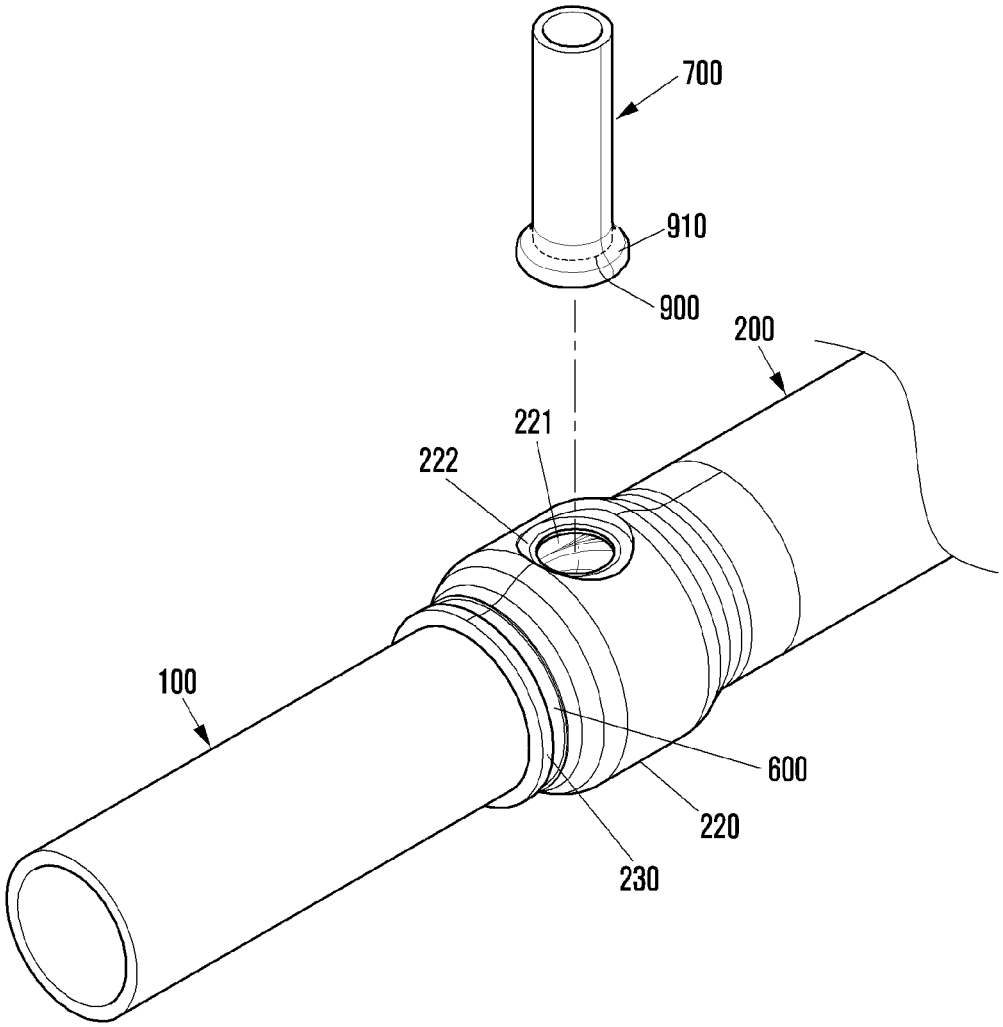
FIG. 8 is a partially exploded perspective view illustrating a state in which each connection pipe is coupled to an outer pipe of a double pipe heat exchanger according to an exemplary embodiment of the present invention.

FIG. 7 is a cross-sectional view illustrating a structure of a temporary fastening portion formed in an outer pipe of a double pipe heat exchanger according to an exemplary embodiment of the present invention, FIG. 8 is a partially exploded perspective view illustrating a state in which each connection pipe is coupled to an outer pipe of a double pipe heat exchanger according to an exemplary embodiment of the present invention, and FIGS. 9A to 9H are diagrams illustrating a process of a method of manufacturing a double pipe heat exchanger according to an exemplary embodiment of the present invention.

Referring to FIGS. 2 and 3, a double pipe heat exchanger 1000 according to the present exemplary embodiment may include an inner pipe 100 that has a first flow channel 110 therein and an outer pipe 200 that houses the inner pipe 100 therein and that has a second flow channel 210 between the inner pipe 100 and the outer pipe 200.

The inner pipe 100 is a pipe in which a first fluid flows through the first flow channel 110. In this case, the first fluid may be a low temperature refrigerant injected into a compressor of a vehicle air-conditioner or may be a high temperature refrigerant supplied to the expansion valve inlet side.

The outer pipe 200 is separately produced from the inner pipe 100 and is produced in a size that may enable insertion of the inner pipe 100 therein. An inner diameter of the outer pipe 200 is generally designed larger than an outer diameter of the inner pipe 100. An assembly tolerance between the inner pipe 100 and the outer pipe 200 forms a gap between both pipes, and the inner pipe 100 and the outer pipe 200 may be smoothly assembled through the gap.

In this case, when the inner pipe 100 is inserted and coupled to the outer pipe 200, a second flow channel 210 is formed between the inner pipe 100 and the outer pipe 200, and such a second flow channel 210 becomes a flow channel in which a second fluid different from a first fluid may flow. The second fluid has a characteristic different from that of the first fluid and may be a low temperature refrigerant injected into a compressor of a vehicle air conditioner or may be a high temperature refrigerant supplied to the expansion valve inlet side. When the first fluid supplied to the inner pipe 100 is a low temperature refrigerant, the second fluid is a high temperature refrigerant; and when the first fluid is a high temperature refrigerant, the second fluid is a low temperature refrigerant. The first and second fluids should be fluids having different physical characteristics for heat transfer, and it is not always necessary that the first and second fluids are refrigerants under a specific temperature and pressure condition.

At an outer circumferential surface of the inner pipe 100, a plurality of first grooves 300 are formed in a spiral shape in a lengthwise direction to enable the second flow channel 210 to be at least partially a spiral shape; and, by the first groove 300, the second flow channel 210 has a spiral shape structure. In this case, when forming the first groove 300 at an outer circumferential surface of the inner pipe 100, the first groove 300 enlarges a surface area of the inner pipe 100 and extends a flow time of a second fluid. Therefore, heat exchange efficiency between a second fluid flowing along the second flow channel 210 and a first fluid flowing along the first flow channel 110 can be enhanced. However, when the first groove 300 is formed at an outer circumferential surface of the inner pipe 100, a portion protruded between the first grooves 300 may contact an inner circumferential surface of the outer pipe 200; thus, a flow rate may not be partially secured.

By carving a helical groove by pressing an outer circumferential surface of the inner pipe 100 with a rolling die (not shown), the first groove 300 may be formed.

The double pipe heat exchanger 100 according to the present exemplary embodiment may include at least one second groove 400 each formed at a portion between two first grooves 300 adjacent to an outer circumferential surface of the inner pipe 100 in order to increase a flow rate of a fluid flowing through the second flow channel 210 and formed along the first groove 300, and a depth of such a second groove 400 may be smaller than that of the first groove 300.

In an exemplary embodiment of the present invention, in a portion between two adjacent first grooves 300, a second groove 400 is formed; but in order to further enlarge a surface area of the inner pipe 100, at least two second grooves 400 may be formed in consideration of a gap between two adjacent first grooves 300.

In this case, the second groove 400 may be a U-shaped groove and may be formed by carving a helical groove by pressing with a rolling die, as in the first groove 300.

More specifically, as shown in FIG. 4, the second groove 400 increases a flow rate of a second fluid flowing through the second flow channel 210 between the outer pipe 200 and the inner pipe 100, and a second fluid flowing to the first groove 300 flows with an increased flow rate through the second groove 400 together with the first groove 300 to increase a contact area with the first fluid flowing to the first flow channel 110 of the inner pipe 100; thus, heat exchange efficiency can be improved.

As shown in FIG. 5A, first grooves 300 according to the present exemplary embodiment are formed at three locations at an outer circumferential surface of the inner pipe 100, and the second grooves 400 are each formed between two first grooves 300 adjacent to an outer circumferential surface of the inner pipe 100. As shown in FIGS. 5B and C, the first groove 300 and the second groove 400 may be formed at various locations such as 4 locations and 6 locations according to a size and structure of the double pipe heat exchanger; and, as described above, the first groove 300 and the second groove 400 may be formed by carving using four and six rolling dies.

As shown in FIGS. 6 and 7, the outer pipe 200 according to the present exemplary embodiment may further include a temporary fastening portion 500 formed by clamping in at least one point in which the inner pipe 100 is coupled to the outer pipe 200 in a state in which the inner pipe 100 is inserted into the outer pipe 200 and that contacts at least one portion of an outer circumferential surface of the inner pipe 100.

Such a temporary fastening portion 500 may include a plurality of pressing grooves 510 in which an inner circumferential surface of the outer pipe 200 pressed by clamping an outer circumferential surface of the outer pipe 200 is formed to press an outer circumferential surface of the inner pipe 100.

In this case, the pressing groove 510 may be formed in a state separated by a predetermined gap along a circumference of an outer circumferential surface of the outer pipe 200. The pressing groove 510 may be formed in two or three rows in a state separated by a predetermined gap in a lengthwise direction of an outer circumferential surface according to a length and size of the outer pipe 200 and the inner pipe 100.

That is, by forming a plurality of pressing grooves 510, which are the temporary fastening portion 500 at an outer circumferential surface of the outer pipe 200, the inner pipe 100 is in a state coupled by temporary fastening to the outer pipe 200; thus, when an additional process is performed, a phenomenon that the inner pipe 100 moves relative to the outer pipe 200 can be prevented and the inner pipe 100 may be thus coupled at an accurate location of the outer pipe 200.

The outer pipe 200 may further include an expanded pipe portion 220 formed by expanding an inner diameter at an end portion of the outer pipe 200 and a reduced pipe portion 230 formed by reducing an end portion of each expanded pipe portion 220; and, in order to inject and discharge an external fluid, a first connection pipe 700 and a second connection pipe 800 may be connected to the expanded pipe portion 220.

In this case, the first connection pipe 700 may be a discharge pipe for discharging an external fluid, and the second connection pipe 800 may be an injection pipe for injecting a fluid.

As shown in FIG. 8, in order to connect each connection pipe to the expanded pipe portion 220 of the outer pipe 200, the expanded pipe portion 220 may include a coupling hole 221 that communicates with the second flow channel 210 by coupling the first connection pipe 700 and the second connection pipe 800 and a latch jaw 222 protruded in a central direction of the coupling hole 221 from an inner circumferential surface of the coupling hole 221.

In this case, the first connection pipe 700 and the second connection pipe 800 may include a coupling protrusion 900 extended from an end portion of each connection pipe to be coupled to the coupling hole 221 and a bead 910 protruded by a predetermined height at an outer circumferential edge of the coupling protrusion 900 to be latched to the latch jaw 222 when each of the connection pipes 700 and 800 is coupled to the coupling hole 221, thereby limiting an insertion depth of each of the connection pipes 700 and 800.

More specifically, the first connection pipe 700 and the second connection pipe 800 are connected through each coupling hole 221 to communicate with the second flow channel 210 of the outer pipe 200. In this case, when the coupling protrusion 900 of each of the connection pipes 700 and 800 is coupled to each coupling hole 221, each bead 910 is latched to the latch jaw 222 of each coupling hole 221; thus, each of the connection pipes 700 and 800 is no longer inserted into the outer pipe 200 through the coupling hole 221.

In each reduced pipe portion 230 according to the present exemplary embodiment, in a state in which the inner pipe 100 is inserted into the outer pipe 200, by pressing an end portion of each reduced pipe portion 230, a pressing groove 600 for maintaining airtightness between the outer pipe 200 and the inner pipe 100 is further formed, and such a pressing groove 600 may be formed by pressing an outer circumferential surface of the reduced pipe portion 230 formed in the outer pipe 200 using a rolling processing method.

That is, by forming the pressing groove 600 for mechanical sealing through a rolling process at each reduced pipe portion 230 of the outer pipe 200 into which the inner pipe 100 is inserted and by finally coupling the inner pipe 100 inserted into the outer pipe 200 to the pressing groove 600 through a welding process, sufficient airtightness can be secured between the outer pipe 200 and the inner pipe 100.

Hereinafter, a method of manufacturing a double pipe heat exchanger 1000 according to an exemplary embodiment of the present invention will be described.

A method of manufacturing a double pipe heat exchanger 1000 according to an exemplary embodiment of the present invention including an outer pipe 200 and an inner pipe 100 having a first flow channel 110 therein and having an outer diameter smaller than an inner diameter of the outer pipe 200 and inserted into the outer pipe 200 to form a second flow channel 210 between the inner pipe 100 and the outer pipe 200 includes (a) preparing the outer pipe 200 and the inner pipe 100, (b) forming a plurality of first grooves 300 to form the second flow channel 210 in a spiral shape at an outer circumferential surface of the inner pipe 100, (c) forming a plurality of second grooves 400 to have a depth smaller than that of the first groove 300 between two first grooves 300 adjacent to an outer circumferential surface of the inner pipe 100, (d) forming an expanded pipe portion 220 at both ends of the outer pipe 200 and a reduced pipe portion 230 at an end portion of the each expanded pipe portion 220, (e) forming a coupling hole 221 at the expanded pipe portion 220, (f) inserting the inner pipe 100 into the outer pipe 200, and (g) forming a pressing groove 600 at a reduced pipe portion 230 of the outer pipe 200 into which the inner pipe 100 is inserted and coupling the inner pipe 100 thereto.

Step f may include a step of forming a temporary fastening portion 500 formed with a plurality of pressing grooves 510 for fixing a location of the inner pipe 100 within the outer pipe 200 by clamping an outer circumferential surface of the outer pipe 200 in a state in which the inner pipe 100 is inserted into the outer pipe 200.

At step g, the pressing groove 600 may be formed with a rolling processing method that presses an outer circumferential surface of each reduced pipe portion 230 formed at both sides of the outer pipe 200 with a rolling roller.

The method may further include, after step g, a step of coupling to the each coupling hole 221 a first connection pipe 700 that injects a fluid from the outside and a second connection pipe 800 that discharges an injected fluid.

The method may further include, after steps c and e, a step of washing by ultrasonic waves the inner pipe 100 in which the first groove 300 and the second groove 400 are formed and the outer pipe 200 in which the coupling hole 221 is formed.

A detailed process of a method of manufacturing a double pipe heat exchanger according to an exemplary embodiment of the present invention will be described with reference to FIGS. 9A to 9H.

Figure 9A:
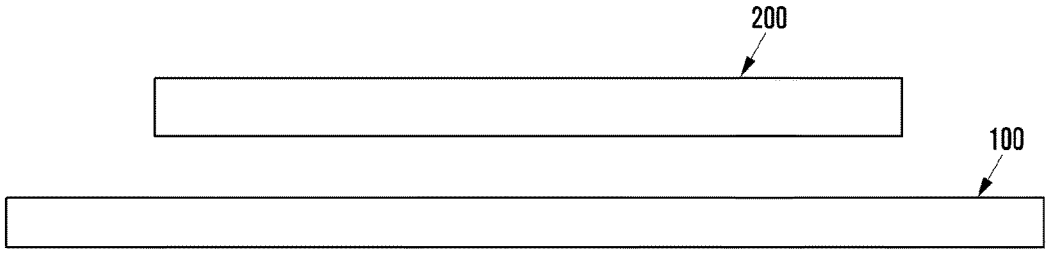
FIGS. 9A to 9H are diagrams illustrating a process of a method of manufacturing a double pipe heat exchanger according to an exemplary embodiment of the present invention.
Figure 9B:
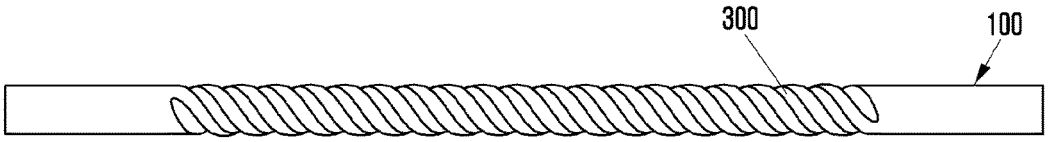
Figure 9C:
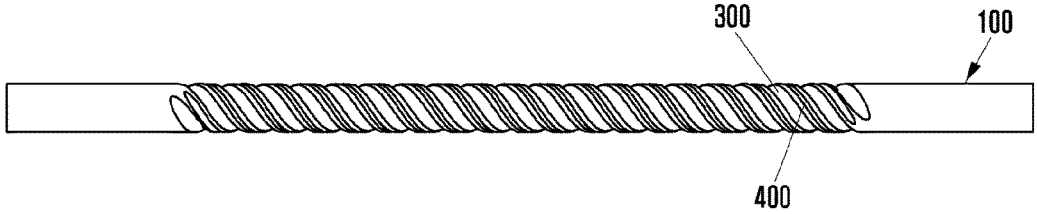

FIG. 9A illustrates a state in which the inner pipe 100 and the outer pipe 200 are prepared, FIG. 9B illustrates a state in which the first groove 300 is formed in the inner pipe 100, and FIG. 9C illustrates that the second groove 400 is formed between the first grooves 300.

Figure 9D:
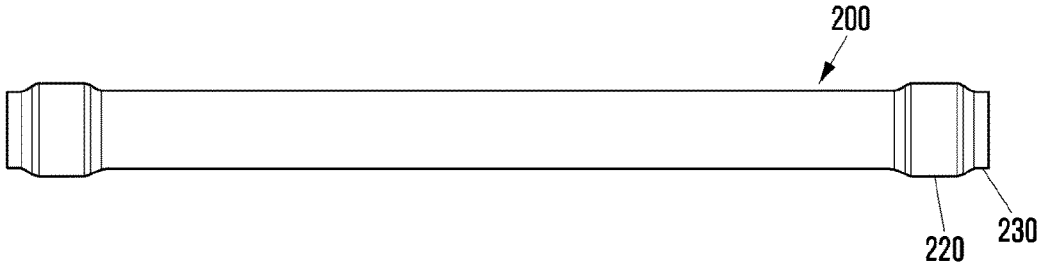
Figure 9E:
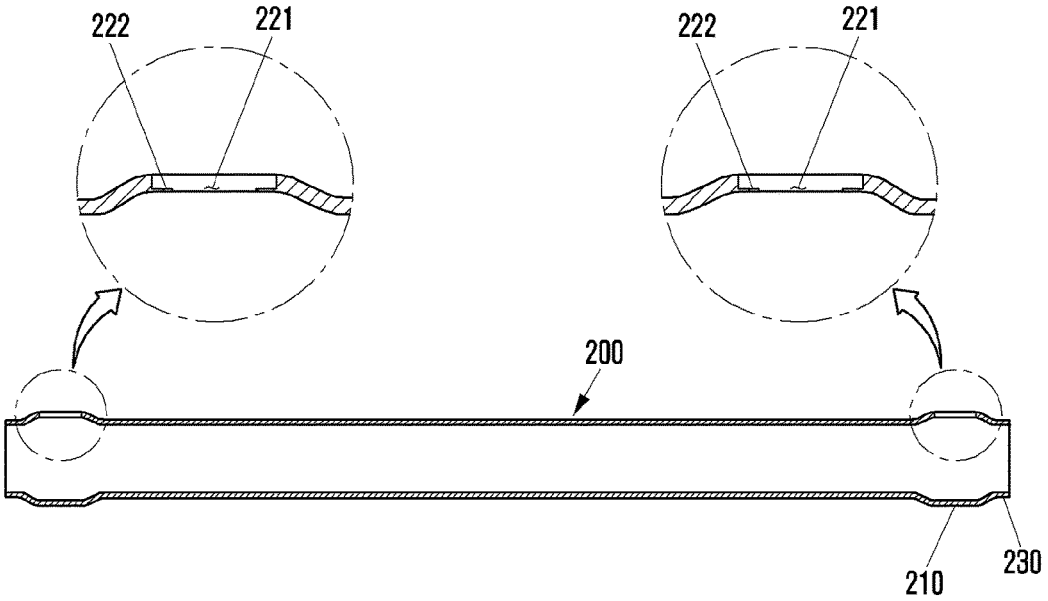
Figure 9F:
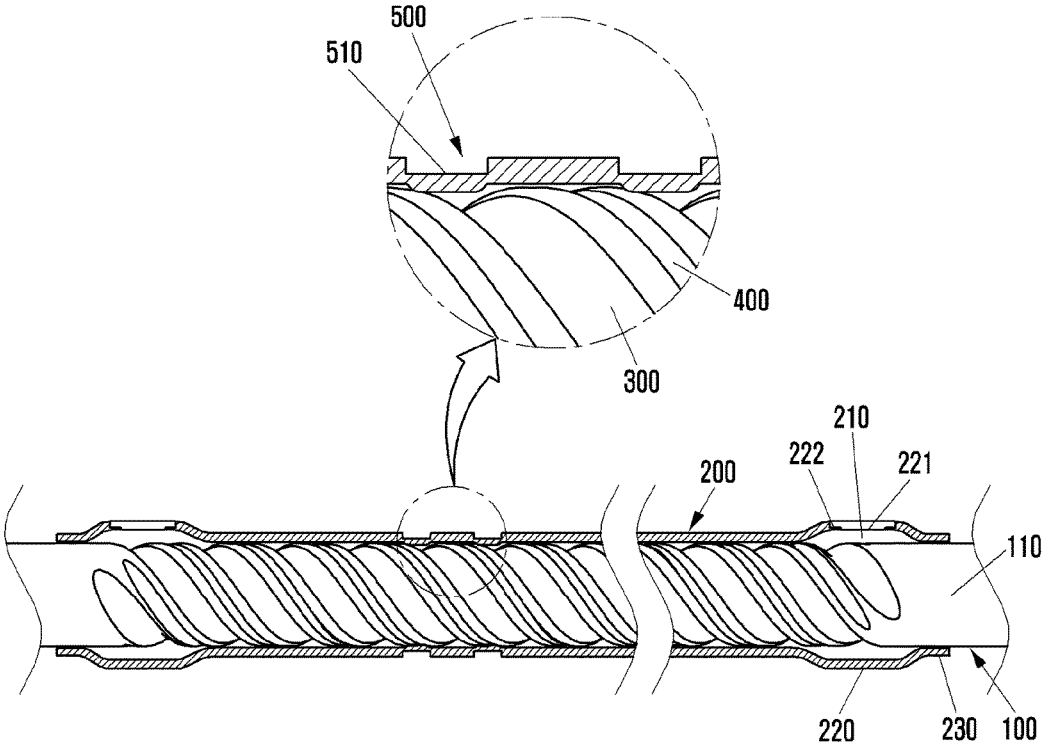

FIG. 9D illustrates a state in which the expanded pipe portion 220 and the reduced pipe portion 230 are formed in the outer pipe 200, FIG. 9E illustrates a state in which the coupling hole 221 is formed in the expanded pipe portion 220, and FIG. 9F illustrates a state in which the temporary fastening portion 500 is formed in a state in which the inner pipe 100 is inserted into the outer pipe 200.

Figure 9G:
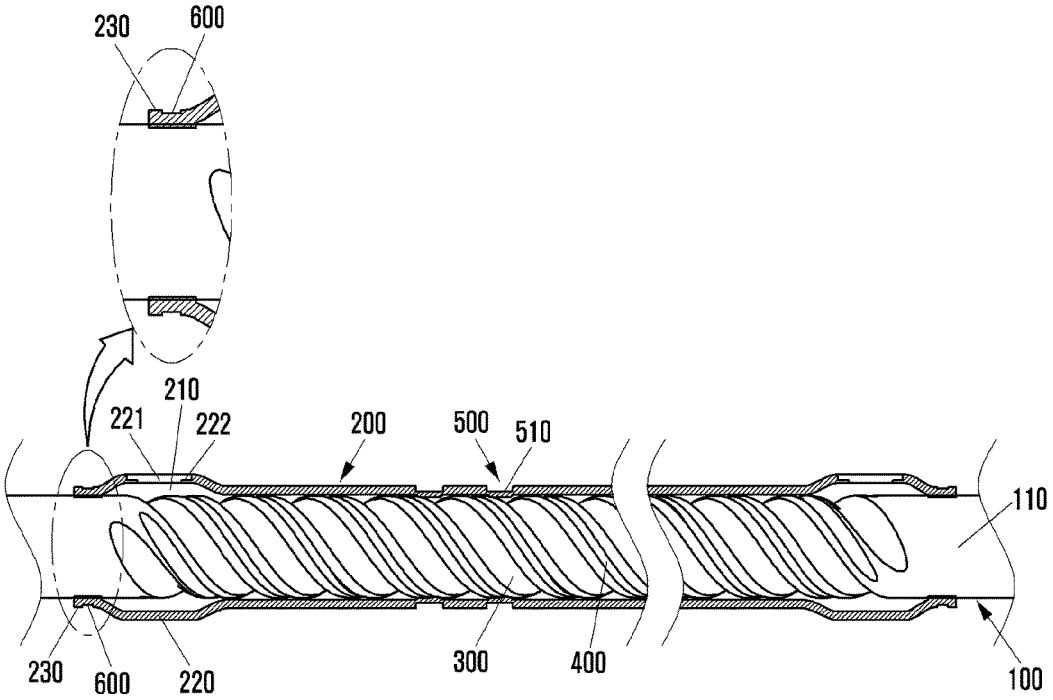
Figure 9H:
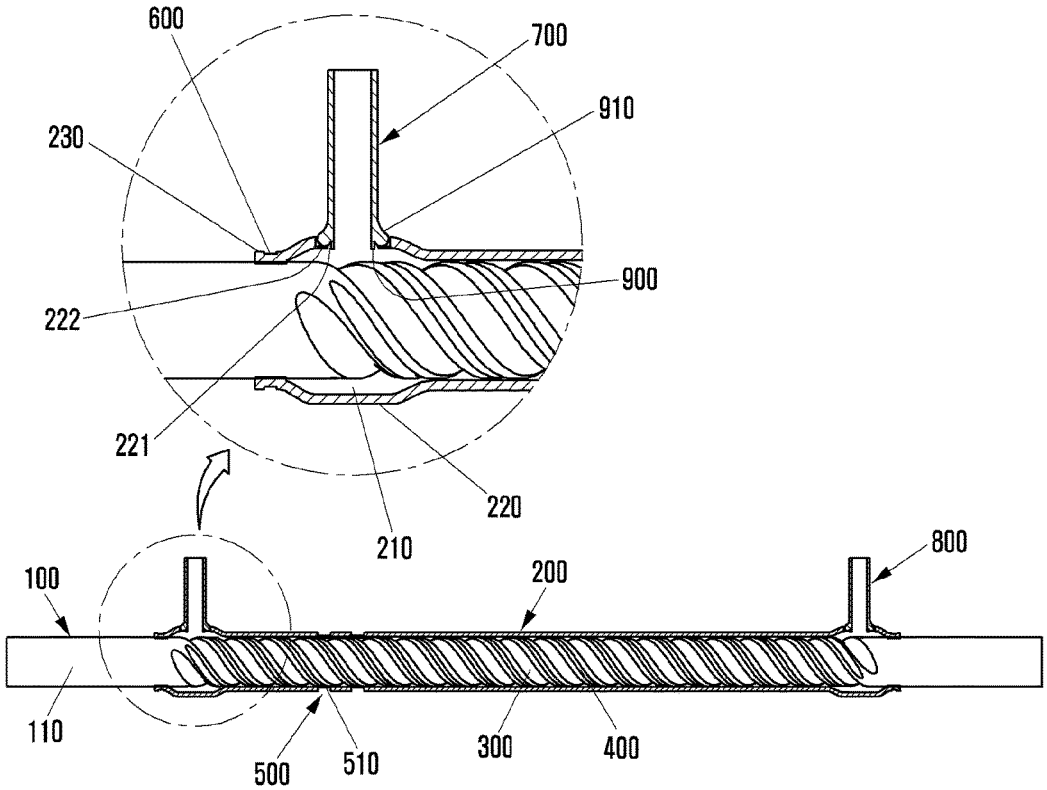

FIG. 9G illustrates a state in which the inner pipe 100 is coupled to the outer pipe 200 by a rolling process in a state in which the inner pipe 100 is temporarily fastened to the outer pipe 200, and FIG. 9H illustrates a state in which each of connection pipes 700 and 800 is connected to each fastening hole 221.

First, in a method of manufacturing a double pipe heat exchanger according to the present exemplary embodiment, the inner pipe 100 and the outer pipe 200 are prepared, as shown in FIG. 9A.

When preparation of the inner pipe 100 and the outer pipe 200 is complete, at an outer circumferential surface of the prepared inner pipe 100, the first groove 300 is formed such that the second flow channel 210 has a spiral shape structure, as shown in FIG. 9B.

In this case, the first groove 300 is formed using a rolling processing method of pressing an outer circumferential surface of the inner pipe 100 with a rolling die.

Thereafter, as shown in FIG. 9C, a plurality of second grooves 400 having a depth smaller than that of the first groove 300 are formed between two first grooves 300 adjacent to an outer circumferential surface of the inner pipe 100. In this case, the second groove 400 is formed using a rolling processing method of pressing with a rolling die. In this case, the second groove 400 is formed in a U-shaped groove structure, and a second fluid flows to the second groove 400 together with the first groove 300.

That is, a second fluid injected into the second flow channel 210 formed between the inner pipe 100 and the outer pipe 200 flows in an increased flow rate through the first groove 300 and the second groove 400 formed at an outer circumferential surface of the inner pipe 100; thus, a contact area with the first fluid flowing through the first flow channel 110 of the inner pipe 100 increases, thereby improving heat exchange efficiency.

In this case, the first groove 300 and the second groove 400 are formed at 3 locations at an outer circumferential surface of the inner pipe 100, but they may be formed at various numbers of locations such as 4 locations or 6 locations according to a size and structure of the double pipe heat exchanger 1000.

Thereafter, as shown in FIG. 9D, an end portion of both sides of the outer pipe 200 is formed in the expanded pipe portion 220 through a forming process; and, by reducing an end portion of each expanded pipe portion 220 through a swaging process, a reduced pipe portion 230 is formed.

Thereafter, as shown in FIG. 9E, when a process of forming the expanded pipe portion 220 and the reduced pipe portion 230 in the outer pipe 200 is complete, by forming through a piercing process the coupling hole 221 for connecting the first connection pipe 700 and the second connection pipe 800 that inject an external fluid into each expanded pipe portion 220 and that discharge an external fluid from each expanded pipe portion 220, each of the connection pipes 700 and 800 communicates with the second flow channel 210 of the outer pipe 200. In this case, a latch jaw 222 that may limit an insertion depth by latching a bead 910 of each of the connection pipes 700 and 800 may be formed.

The coupling hole 221 may be formed through a press process or a drill process. As described above, when forming is complete of the expanded pipe portion 220, the reduced pipe portion 230, and the coupling hole 221 at the outer pipe 200, a test step for determining a process state may be performed.

Although not shown, an ultrasonic wave washing process may be performed of washing by ultrasonic waves the inner pipe 100 in which the first groove 300 and the second groove 400 are formed and the outer pipe 200 in which the expanded pipe portion 220, the reduced pipe portion 230, and the coupling hole 221 are formed. That is, in order to remove any foreign substance occurring in a process of processing the outer pipe 200 and the inner pipe 100, an ultrasonic wave washing process is performed.

In an exemplary embodiment of the present invention, the first groove 300 and the second groove 400 are formed at the inner pipe 100 and, as a next process, a process of forming the expanded pipe portion 220, the reduced pipe portion 230, and the coupling hole 221 at the outer pipe 200 is suggested; but two processes may be simultaneously performed and a shaping process of the outer pipe 200 may be first performed according to a production situation of a double pipe heat exchanger.

Thereafter, as shown in FIG. 9F, the inner pipe 100 is inserted into the outer pipe 200. In this case, both end portions of the inner pipe 100 are coupled to the inside of the outer pipe 200 to be exposed to the outside of the outer pipe 200.

Simultaneously, in a state in which the inner pipe 100 is inserted into the outer pipe 200, by pressing an outer circumferential surface of the outer pipe 200, a process of forming a temporary fastening portion 500 formed with a plurality of pressing grooves 510 for fixing a location of the inner pipe 100 at the inside of the outer pipe 200 may be performed.

In this case, the pressing groove 510 is formed in a state separated by a predetermined gap along a circumference of an outer circumferential surface of the outer pipe 200, and the pressing groove 510 may be formed in two or three rows in a state separated by a predetermined gap in a lengthwise direction of an outer circumferential surface according to a length and size of the outer pipe 200 and the inner pipe 100.

That is, by forming a plurality of pressing grooves 510, which are the temporary fastening portion 500 at an outer circumferential surface of the outer pipe 200, in a state in which the inner pipe 100 is coupled by temporary fastening to the outer pipe 200, when an additional process is performed, a phenomenon that the inner pipe 100 moves relative to the outer pipe 200 can be prevented; thus, the inner pipe 100 may be coupled at an accurate location of the outer pipe 200.

Thereafter, as shown in FIG. 9G, in a state in which the inner pipe 100 is temporarily fastened to the outer pipe 200, by forming the pressing groove 600 of an end portion of each reduced pipe portion 230 of the outer pipe 200, sufficient airtightness may be maintained between the outer pipe 200 and the inner pipe 100.

In this case, the pressing groove 600 is formed by pressing an outer circumferential surface of a reduced pipe portion 230 formed at the outer pipe 200 through a rolling processing method of pressing with a rolling roller.

Thereafter, although not shown, the inner pipe 100 is finally coupled to the outer pipe 200 by a welding process.

Thereafter, as shown in FIG. 9H, the first connection pipe 700 and the second connection pipe 800 are inserted and coupled to each coupling hole 221 formed in each expanded pipe portion 220.

In this case, when inserting and coupling the coupling protrusion 900 formed in the first connection pipe 700 and the second connection pipe 800 to each coupling hole 221, each bead 910 formed in each coupling protrusion 900 is latched to a latch jaw 222 of each coupling hole 221; thus, the first connection pipe 700 and the second connection pipe 800 are no longer inserted into the outer pipe 200 through the coupling hole 221.

By bonding a portion in which the first connection pipe 700 and the second connection pipe 800 are coupled to each coupling hole 221 through a welding process, the inner pipe 100 and each connection pipe may be finally coupled to the outer pipe 200.

Production of the double pipe heat exchanger 100 is complete through the foregoing process.

Although exemplary embodiments of the present invention have been described in detail hereinabove, it should be clearly understood that many variations and modifications of the basic inventive concepts herein described, which may appear to those skilled in the art, will still fall within the spirit and scope of the exemplary embodiments of the present invention as defined in the appended claims.

The invention claimed is:

1. A double pipe heat exchanger, comprising:

an outer pipe;

an inner pipe having a first flow channel therein and having an outer diameter smaller than an inner diameter of the outer pipe, the inner pipe inserted into the outer pipe to form a second flow channel between the inner pipe and the outer pipe, the inner pipe having an outer circumferential surface including a plurality of outermost peripheral portions;

a plurality of first grooves formed in a spiral shape in a lengthwise direction in the outer circumferential surface to enable the second flow channel to at least partially have a spiral shape; and at least one second groove formed in the outer circumferential surface between two adjacent first grooves, wherein each first groove is disposed between a first pair of adjacent outermost peripheral portions, and wherein each second groove is disposed between a second pair of adjacent outermost peripheral portions different from the first pair of adjacent outermost peripheral portions.

2. The double pipe heat exchanger of claim 1, wherein the second groove has a depth smaller than that of the first groove.

3. The double pipe heat exchanger of claim 1, wherein the second groove is a U-shaped groove.

4. The double pipe heat exchanger of claim 1, wherein the first grooves are each formed at 3 locations in outer circumferential surface of the inner pipe.

5. The double pipe heat exchanger of claim 1, wherein the outer pipe comprises a temporary fastening portion formed by clamping in at least one point in which the inner pipe is coupled to the outer pipe in a state in which the inner pipe is inserted into the outer pipe and that contacts at least one portion of the outer circumferential surface of the inner pipe.

6. The double pipe heat exchanger of claim 5, wherein the temporary fastening portion comprises a plurality of pressing grooves in which an inner circumferential surface of the outer pipe is pressed by pressing an outer circumferential surface of the outer pipe is formed to press the outer circumferential surface of the inner pipe, and the pressing groove is formed in a state separated by a predetermined gap along a circumference of an outer circumferential surface of the outer pipe.

7. The double pipe heat exchanger of claim 1, wherein both ends of the outer pipe comprise a first connection pipe formed in a state in which a portion of the outer pipe is expanded to inject a fluid from the outside, an expanded pipe portion to which a second connection pipe that discharges an injected fluid is connected, and a reduced pipe portion in which an end portion of the each expanded pipe portion is formed in a reduced pipe state.

8. The double pipe heat exchanger of claim 7, wherein the expanded pipe portion comprises a coupling hole that communicates with the second flow channel by coupling the first connection pipe and the second connection pipe and a latch jaw protruded in a central direction of the coupling hole from an inner circumferential surface of the coupling hole, and the first connection pipe and the second connection pipe comprise a coupling protrusion extended from the each connection pipe to be coupled to the coupling hole and a bead protruded by a predetermined height at an outer circumferential edge of the coupling protrusion to be latched to the latch jaw when each connection pipe is coupled to the coupling hole to limit an insertion depth of the each connection pipe.

9. The double pipe heat exchanger of claim 8, wherein the each reduced pipe portion has a pressing groove that presses an end portion of the each reduced pipe portion in a state in which the inner pipe is inserted into the outer pipe to maintain airtightness between the outer pipe and the inner pipe.

10. The double pipe heat exchanger of claim 9, wherein the pressing groove presses an outer circumferential surface of the reduced pipe portion with a rolling processing method and thereby an inner circumferential surface of the reduced pipe portion comes in close contact with an outer circumferential surface of the inner pipe.

* * * * *